United States Patent [19]

Nagy

[11] Patent Number: 4,732,024

[45] Date of Patent: Mar. 22, 1988

[54] LOCK WITH SECURITY CYLINDER AND EXTENDED KEY

[76] Inventor: David Nagy, 21 Maynard Avenue, Apt. 605, Toronto, Ontario, Canada, M6K 2Z8

[21] Appl. No.: 21,321

[22] Filed: Mar. 3, 1987

[51] Int. Cl.[4] ..... E05B 17/14

[52] U.S. Cl. ..... 70/427; 70/423

[58] Field of Search ..... 70/423, 424, 425, 426, 70/427, 428, 440, 232, DIG. 57, 381, 452, 454, 416, 429, 430

[56] References Cited

U.S. PATENT DOCUMENTS

| | | | |
|---|---|---|---|
| 3,572,063 | 3/1971 | Foote | 70/440 |
| 3,765,197 | 10/1973 | Foote | 70/58 |
| 4,444,031 | 4/1984 | Watson | 70/232 |

FOREIGN PATENT DOCUMENTS

| | | | |
|---|---|---|---|
| 2141478 | 12/1984 | United Kingdom | 70/423 |

*Primary Examiner*—Robert L. Wolfe

*Attorney, Agent, or Firm*—Fleit, Jacobson, Cohn & Price

[57] ABSTRACT

A security lock for a door or other closure in which it is desired to control access therethrough. More specifically, the invention relates to the addition of a tube rigidly affixed to a lock cylinder in enclosing relation to the key barrel and the key receiving slot in the barrel with the tube including a pair of diametrically opposed openings so that a padlock may be inserted therethrough to prevent access to the key slot in the barrel thereby preventing the insertion of a key and also preventing access to the slot to prevent the lock from being picked. The key used with the lock requires an extension in the shank or blade of the key so that the extra length required by the added tube will be accommodated by the extension in the key blade or shank.

2 Claims, 4 Drawing Figures

FIG. 1
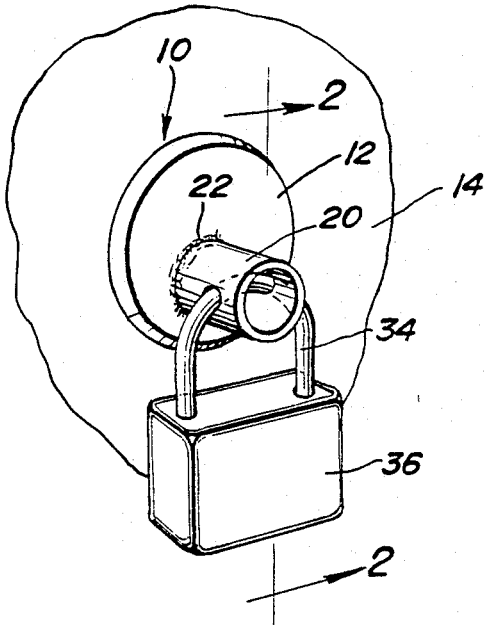
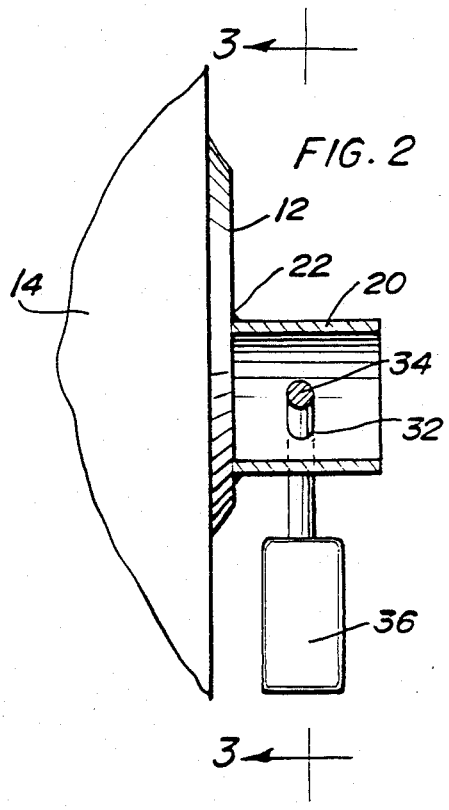
FIG. 2
FIG.3
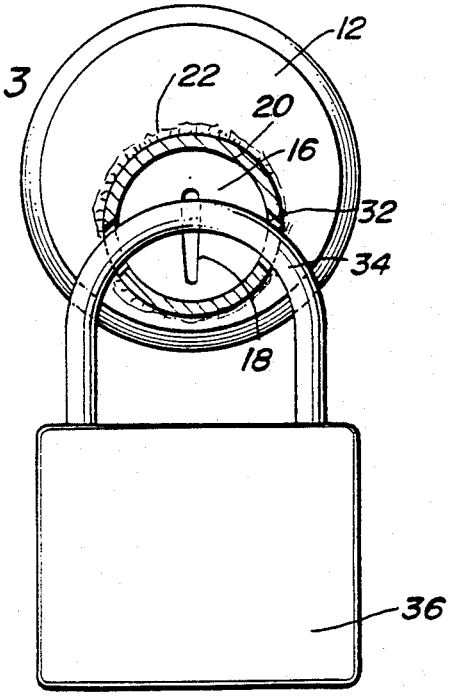
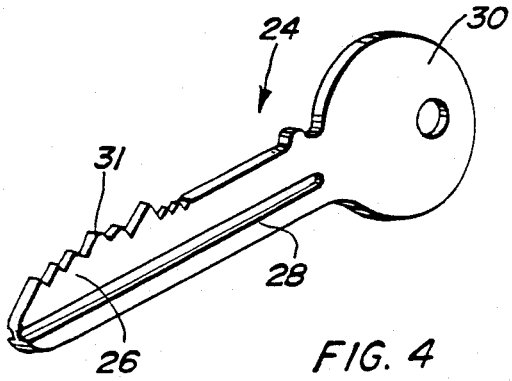
FIG. 4

LOCK WITH SECURITY CYLINDER AND EXTENDED KEY

BACKGROUND OF THE INVENTION

1. FIELD OF THE INVENTION

The present invention generally relates to a security lock for a door or other closure in which it is desired to control access therethrough. More specifically, the invention relates to the addition of a tube rigidly affixed to a lock cylinder in enclosing relation to the key barrel and the key receiving slot in the barrel with the tube including a pair of diametrically opposed openings so that a padlock may be inserted therethrough to prevent access to the key slot in the barrel thereby preventing the insertion of a key and also preventing access to the slot to prevent the lock from being picked. The key used with the lock requires an extension in the shank or blade of the key so that the extra length required by the added tube will be accommodated by the extension in the key blade or shank.

2. INFORMATION DISCLOSURE STATEMENT

Various locks have been provided and various safety devices and security devices have been provided for conventional lock cylinders. However, none of the prior art known to applicant discloses a device equivalent to that disclosed in this application. A separate information disclosure statement will be filed.

SUMMARY OF THE INVENTION

An object of the present invention is to provide a security lock in the form of a modification of a conventional cylinder lock in the form an extension tube rigidly affixed to the cylinder such as by welding or the like in enclosing relation to the barrel and key slot so that it is necessary that the lock be operated by a special key having a longitudinally elongated blade or shank in which the portion of the blade or shank which actuates the pins in the lock barrel will have sufficient length to be inserted into the key slot for operating the pins in the usual manner.

A further object of the invention is to provide a rigid tube on the lock cylinder in enclosing relation to the end of the barrel having the key slot therein in accordance with the preceding object in which the tube includes diametrically opposed apertures for receiving the hasp of a padlock so that access to the key slot cannot be obtained without removing the padlock thereby providing the necessity of utilizing two keys to operate the lock, one key to operate the padlock and a second special key to operate the cylinder lock.

A further object of the invention is to provide a security lock in accordance with the preceding objects in which the padlock extending across the tube prevents access to the key slot in order to prevent the lock from being picked.

Still another object of the invention is to provide a security lock which is simple in construction, easy to install on an existing cylinder lock or incorporate into a new cylinder lock and effective to prevent undesired access to an enclosed space through a closure, door or the like.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the security lock of the present invention.

FIG. 2 is a vertical sectional view taken substantially upon a plane passing along section line 2—2 on FIG. 1 illustrating the structural details of the invention.

FIG. 3 is a vertical sectional view taken substantially upon a plane passing along section line 3—3 on FIG. 2 illustrating further structural details of the invention.

FIG. 4 is a perspective view of the special key with extending blade or shank utilized in combination with the modified cylinder lock.

DESCRIPTION OF THE PREFERRED EMBODIMENT

Referring now specifically to the drawings, the modified security lock of the present invention is generally designated by the reference numeral 10 and includes a conventional lock cylinder 12 mounted in a door 14 or other closure in order to lock the door in closed position. The lock cylinder 12 includes a conventional barrel 16 having a slot 18 formed therein for receiving a key in a conventional manner with the key being constructed so that it will operate the pins associated with the lock cylinder and barrel so that the barrel can be rotated to unlock the lock in a conventional manner.

The present invention involves the addition of a rigid tube 20 attached to the lock cylinder 12 by welding 22 or it can be constructed unitarilly with the cylinder if desired. The tube 20 forms a cylindrical extension that encloses the end of the barrel 16 and also encloses the slot 18 and has an internal diameter generally equal to the external diameter of the barrel 16. Thus, in order to operate the lock 10, a special key generally designated by the numeral 24 is required in which the blade or shank 26 is provided with an extension 28 between the handle portion 30 of the key and the lands and grooves 31 along one edge thereof so that the extension 28 on the key 24 is substantially as long as the tube 20 so that a person having the special key 24 can operate the lock 10 in the usual manner by inserting the shank 26 into the slot 18 and then rotating the key and thus the barrel of the lock to open the lock.

In addition to requiring the special key, the tube 20 is provided with a pair of generally diametrically opposed openings 32 which receive the hasp 34 of a padlock 36 of conventional construction in which the padlock is operated by a key inserted either into the side or into the bottom of the padlock 36 to open the hasp. Thus, the hasp 34 extends generally diametrically across the interior of the tube 20 although in a curved or arcuate manner as illustrated in FIG. 3 thereby preventing the key 24 from being inserted into the slot 18 as long as the hasp 34 is in position. Also, the hasp 34 blocks the slot 18 to prevent access thereto by picking instruments or tools thereby reducing the possibility of the lock being picked.

The tube 20 may be constructed of metal or other suitable rigid material and may have a length that is effective for the purposes intended but not sufficiently long to provide an obstruction or danger to persons walking in the vicinity of the lock. The tube 20 may be added to existing lock structures by retrofitting or may be incorporated into new cylinder locks. This structure enables a person to prevent unauthorized access to the interior of an enclosure by opening the door and also enables a person to prevent others that may have a master key to the lock from gaining access to an enclosed space or the like. The tube or tubular extension requires the use of a special key with an elongated blade having an extension incorporated therein and also requires the use of a key that will operate the padlock thereby providing double security to the door or other closure member.

The foregoing is considered as illustrative only of the principles of the invention. Further, since numerous modifications and changes will readily occur to those skilled in the art, it is not desired to limit the invention to the exact construction and operation shown and described and, accordingly, all suitable modifications and equivalents may be resorted to, falling within the scope of the invention.

What is claimed as new is as follows:

1. A security lock comprising a relatively short, rigid tube adapted to be secured rigidly and stationarily to the face of a lock cylinder, said tube having an internal diameter only slightly larger than the diameter of a lock barrel and adapted to be disposed in enclosing relation to the end of the barrel and key slot in the barrel thereby requiring the use of a key having an extension incorporated into the balde thereof in order to insert the key blade into the key slot in the barrel, said tube including a pair of diametrically opposed apertures therein oriented adjacent the center of the tube for receiving the hasp of a padlock thereby requiring initial operation of the padlock and subsequent insertion of a key with extension for operating the lock cylinder, said tube and hasp of the padlock preventing direct access to the key slot in the barrel to prevent access of a key to the key slot and to prevent access thereto in order to reduce the capability of the lock being picked.

2. In combination, a cylinder lock having a cylinder with a face and a rotatable barrel with a key slot therein installed in a door or other closure with the face of the cylinder being generally flush with the surface of the door, a rigid tube affixed to the face of the cylinder and projecting axially therefrom and laterally from the surface of the door, said tube being substantially smaller than the cylinder and having an internal diameter only slightly greater than the diameter of the barrel, said tube being rigidly and stationarily mounted on the cylinder in enclosing relation to the end of the barrel and the end of the key slot and extending outwardly a short distance therefrom, said tube having an open end and a constant internal diameter, and a key with an extension incorporated into the blade thereof to enable the key to be inserted into the key slot for operating the barrel, and a padlock having a hasp that is openable and closable with means provided to operate the padlock, said tube including a pair of diametrically opposed apertures spaced outwardly from the face of the cylinder and adjacent the center of the tube for receiving the hasp of the padlock to prevent access to the key slot thereby preventing the cylinder lock from being operated by the special key until the padlock has benn removed and preventing access to the key slot to reduce the possibility of the lock being picked.

* * * * *